US006334781B1

(12) United States Patent
Nishio et al.

(10) Patent No.: US 6,334,781 B1
(45) Date of Patent: Jan. 1, 2002

(54) ELECTRICAL CONNECTOR FOR FLEXIBLY ATTACHING CIRCUIT BOARD

(75) Inventors: Atsushi Nishio, Ibaraki; Katsuhiro Hori, Mito; Kazuhiro Okazaki, Hitachinaka; Fumihiro Hosoya, Ibaraki, all of (JP)

(73) Assignee: Mitsumi Electric Co., Ltd. (JP)

( * ) Notice: Subject to any disclaimer, the term of this patent is extended or adjusted under 35 U.S.C. 154(b) by 0 days.

(21) Appl. No.: 09/513,326

(22) Filed: Feb. 25, 2000

(30) Foreign Application Priority Data

Feb. 26, 1999 (JP) ..... 11-049326

(51) Int. Cl.[7] ..... H01R 12/00
(52) U.S. Cl. ..... 439/76.1; 439/248
(58) Field of Search ..... 439/76.1, 404, 439/499, 492, 498, 676, 607, 248, 247

(56) References Cited

U.S. PATENT DOCUMENTS 3,617,811 A * 11/1971 McVoy ..... 439/76.1
4,012,094 A * 3/1977 VaRenssen et al. ..... 439/76.1
4,626,962 A * 12/1986 Ahn et al. ..... 439/76.1
4,766,520 A * 8/1988 Hubber et al. ..... 439/76.1
4,934,943 A * 6/1990 Klein et al. ..... 439/248
4,940,417 A * 7/1990 Hyogo et al. ..... 439/248
5,020,996 A * 6/1991 Cheng ..... 439/76.1
5,362,243 A * 11/1994 Huss et al. ..... 439/76.1
5,947,752 A * 9/1999 Wu ..... 439/76.1
6,008,982 A * 12/1999 Smith ..... 439/76.1
6,062,888 A * 5/2000 Takiguchi ..... 439/248
6,109,950 A * 8/2000 Trammel ..... 439/76.1
6,146,184 A * 11/2000 Wilson et al. ..... 439/374

FOREIGN PATENT DOCUMENTS

JP 433278 * 2/1992 ..... 439/248

* cited by examiner

*Primary Examiner*—Brian Sircus
*Assistant Examiner*—J. F. Duverne
(74) *Attorney, Agent, or Firm*—Morrison Law Firm

(57) ABSTRACT

A flexibly mounted miniature circuit board moves slightly within an electrical connector preventing electrical failure when subjected to improper forces. The miniature circuit board is electrically connected to an inner connector. The inner connector has a plurality of electrical connectors for connecting to external contacts. The miniature circuit board and inner connector are surrounded by an electrically insulating resin case. The inner connector is rigidly mounted to the insulating case. The miniature circuit board is soldered to the inner connector.

6 Claims, 2 Drawing Sheets

ELECTRICAL CONNECTOR FOR FLEXIBLY ATTACHING CIRCUIT BOARD

BACKGROUND TO THE INVENTION

The present invention relates to an electric connector. In particular, it relates to a connector used in connecting between devices with differing connection modes.

As is known in the prior art, in recent personal computers, there is a trend towards using an electrical connector called a universal serial bus (USB) connector. In order to connect peripheral devices with a different connection mode to the above personal computer, a conversion connector must be used to convert from a USB connector mode of connection to another mode.

This conversion connector has a connector case, which is formed with an electrical insulating resin. A miniature circuit board, on which a USB connector is mounted, is built into the interior of the connector case. A connection cable, which has a connector with another connection mode, is joined to the miniature circuit board.

In embedding a USB connector and a miniature circuit board inside a connector case, the miniature circuit board, on which the USB connector is already mounted, is fastened securely inside the connector case by a fastening screw, or the like. External forces applied to the USB connector or the connection cable is transferred to the connector case via the miniature circuit board.

However, in the prior art conversion connector, if when connecting the companion connector for the USB connector, the USB connector is twisted by the companion connector, the force from the companion connector to the USB connector is transferred to the miniature circuit board via the soldered parts of the miniature circuit board at the contacts and the like of the USB connector. As a result, the soldered parts or the conductive foil of the miniature circuit board become separated. This often results in failure of the electrical connections of the electrical connector causing the conversion connector to stop functioning.

OBJECT AND SUMMARY OF THE INVENTION

An object of the present invention is to provide an electrical connector that overcomes the limitations of the prior art.

Another object of the present invention is to provide an electrical connector with a soldered part between an inner connector and a miniature circuit board that does not become separated. even when a strong outside force is applied.

Yet another object of the present invention is to provide a conversion connector with a soldered part between an inner connector and a miniature circuit board that does not separate even when a strong outside force is applied.

In order to achieve this object, the present invention proposes a connector, the connector housing a miniature circuit board inside a connector case formed by an electrical insulating resin; the miniature circuit board mounting an inner connector which is surrounded by a shield case; the connector connecting a core wire of a connection cable, which is introduced inside the connector case, to the miniature circuit board, wherein: the inner connector is supported inside the connector case in an immobile condition; the miniature circuit board, which is soldered to the inner connector, is supported by the connector case in a condition that allows for slight movement.

In the description of the preferred embodiment which is described below, the following will be described: a construction, wherein: the shield case of the inner connector is in a condition that does not allow for movement in a front-rear direction due to a stopper wall inside the connector case; the miniature circuit board is supported inside the connector case in a condition that allows for slight movement in the front-rear direction due to a board stopper; the shield case is in a condition that allows for no movement in the vertical direction due to an upper pinning protrusion and a lower pinning protrusion which are formed protruding inside the connector case.

Briefly stated, the present invention provides a flexibly mounted miniature circuit board that moves slightly within an electrical connector preventing electrical failure when subjected to improper forces. The miniature circuit board is electrically connected to an inner connector. The inner connector has a plurality of electrical connectors for connecting to external contacts. The miniature circuit board and inner connector are surrounded by an electrically insulating resin case. The inner connector is rigidly mounted to the insulating case. The miniature circuit board is soldered to the inner connector.

According to an embodiment of the present invention, there is provided an electrical connector housing a miniature circuit board inside a connector case comprising: an inner connector electrically connected to the miniature circuit board; a shield case substantially surrounding the inner connector; means for rigidly attaching the inner connector to the connector case; and means for flexibly attaching the miniature circuit board to the connector case whereby the miniature circuit board is allowed a range of motion without stressing the miniature circuit board.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
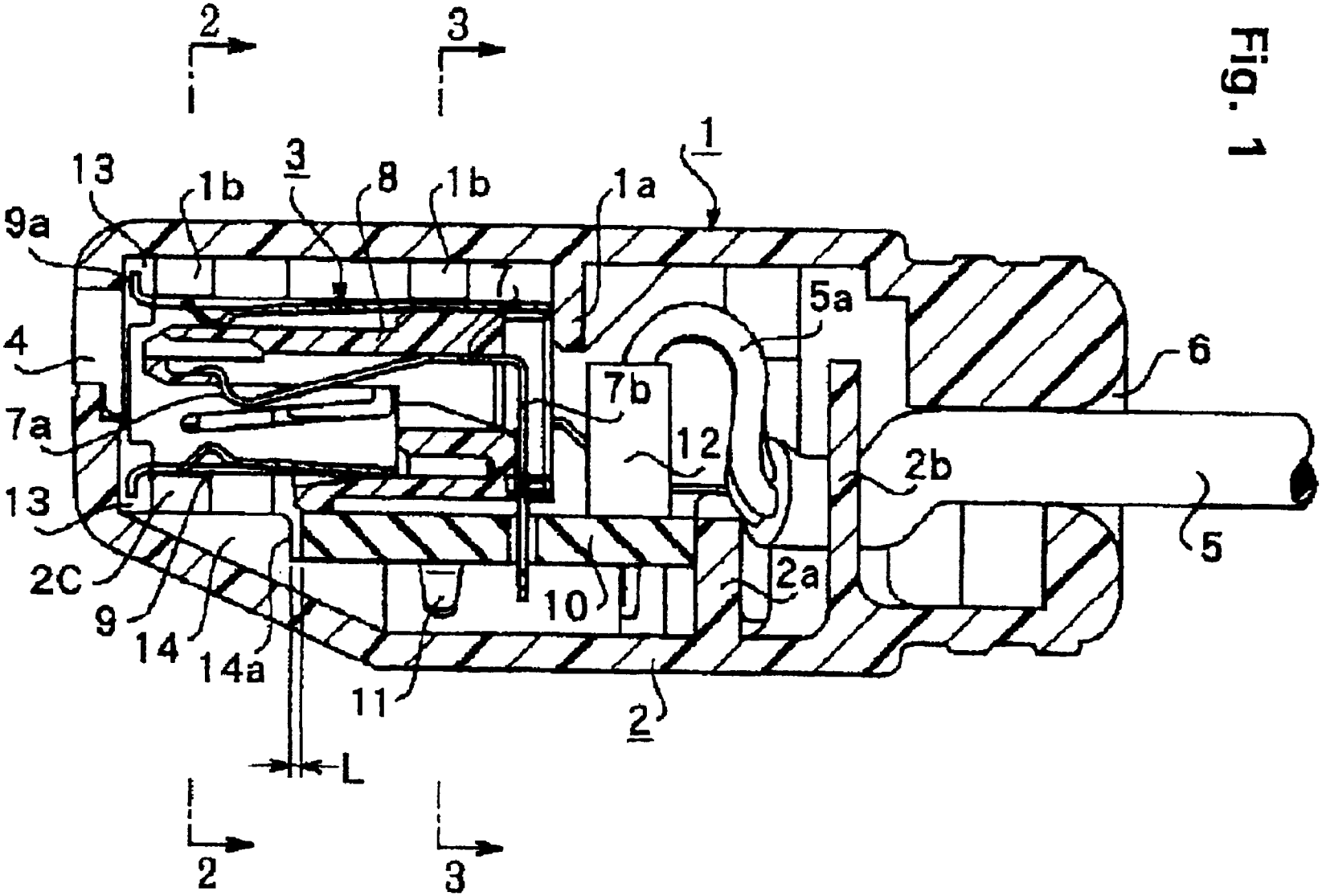
FIG. 1 is a whole cross-section of a conversion connector of the present invention.
Figure 2:
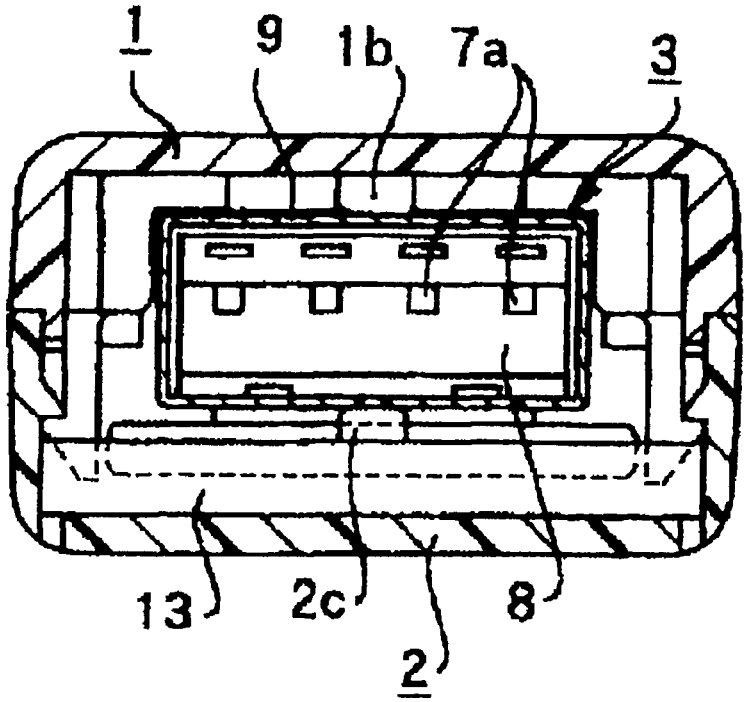
FIG. 2 is a cross-section along line 2—2 of FIG. 1.
Figure 3:
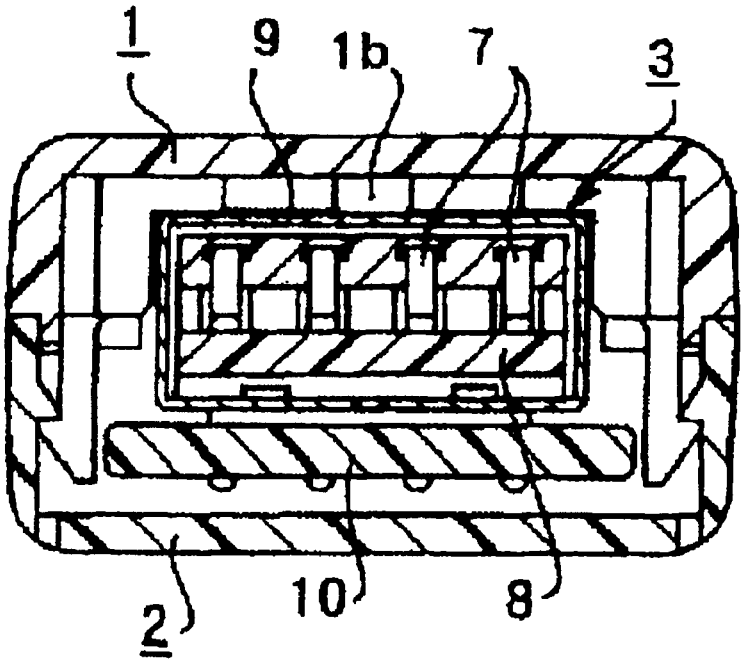
FIG. 3 is a cross-section along line 3—3 of FIG. 1.

Referring to FIGS. 1–3, a conversion connector for converting a USB connector to another connection mode is equipped with an upper case 1 and a lower case 2, which are both injection molded with electrical insulating resin.

An inner connector 3, which is shown as a USB connector, is built into the interior of upper case 1 and lower case 2. An insertion opening 4, into which the companion connector (not shown) can be inserted, is formed in the front part of upper case 1 and lower case 2. A cord hole 6, into which one end of a connection cable 5 can be introduced, is formed on the rear part of upper case 1 and lower case 2.

Referring now specifically to FIG. 1, inner connector 3 is equipped with an insulated core 8 and includes a plurality of contacts 7 which are aligned in a direction that is perpendicular to the paper's surface. Insulated core 8 is surrounded by a shield case 9, which is a metal plate bent into a rectangular tube. A contact end part 7*a* for each of the contacts 7, is elastically pressed against the contacts on the companion connector (not shown), which is inserted into insertion opening 4. External connection end 7*b* of contacts 7 are bent at a right angle with respect to contact end parts 7*a* towards a miniature circuit board 10.

A fastening lug 11, which is cut and offset from the side wall of shield case 9 and external connection ends 7*b* are soldered on a conductive foil (not shown) of miniature circuit board 10. Inner connector 3 is mounted on miniature circuit 10 by soldering fastening lug 11 and external connection ends 7*b*.

A core wire socket 12 connects a core wire 5*a* of connection cable 5 and is mounted on the surface of miniature circuit board 10. Core wire socket 12 and external connection end 7*b* for each contact 7 is electrically connected via the conductive foil (not shown).

An opening flange 9*a*, which is formed in a unitary manner on the front part of shield case 9, is placed in a framing groove 13. Framing groove 13 is formed on the front wall inner part of upper case 1 and lower case 2. Opening flange 9*a* prevents shield case 9 from slipping out of the connector case. In order to prevent any movement of shield case 9 in the front-to-rear direction, a stopper wall 1*a* is formed in a unitary manner on the interior of upper case 1. By abutting against stopper wall 1*a*, the front surface of upper case 1 fits tightly against the rear surface of shield case 9.

In order to restrict the movement in the front-rear direction of miniature circuit board 10, a board stopper 2*a* is formed in a unitary manner on the interior of lower case 2. Miniature circuit board 10 is positioned between the front surface of board stopper 2*a* and a rear surface 14*a* of a holding rib 14. A small amount of space L is present between the front surface of board stopper 2*a* to rear surface 14*a* of holding rib 14 and miniature circuit board 10. As a result, miniature circuit board 10 has a certain amount of freedom of movement in the front-rear direction.

A cable holder 2*b* is formed in a unitary manner at a position near cord hole 6 in the interior of lower case 2. Connection cable 5 is attached to cable holder 2*b* preventing it from slipping out.

In order to reliably anchor inner connector 3 inside the connector case, an upper pinning protrusion 1*b* and a lower pinning protrusion 2*c*, vertically opposing each other, protrude from the lower surface of upper case 1 and from the upper surface of lower case 2. When assembling the cases together, the end surfaces of upper pinning protrusion 1*b* and lower pinning protrusion 2*c* fit tightly against the upper surface and lower surface of shield case 9 of inner connector 3. As a result, outside forces, such as a twisting force and the like, applied to inner connector 3 are borne by upper pinning protrusion 1*b* and lower pinning protrusion 2*c*.

Inner connector 3, which is mounted on miniature circuit board 10, is built into the interior of upper case 1 and lower case 2. Shield case 9 of inner connector 3 is rigidly affixed inside the connector case so as to be basically immobile. Miniature circuit board 10 is flexibly affixed to allow slight movement.

Stopper wall 1*a* restrains shield case 9 of inner connector 3 from moving in the front-rear direction. Upper pinning protrusion 1*b* and lower pinning protrusion 2*c* tightly fit above and below shield case 9 respectively, and as a result, any twisting force from the companion connector (not shown) which is inserted into insertion opening 4 is borne by stopper wall 1*a*, upper pinning protrusion 1*b*, and lower pinning protrusion 2*c*. This transfers the force to upper case 1 and lower case 2.

Contacts 7 of inner connector 3 are soldered to miniature circuit board 10 in a condition that allows for slight movement with respect to lower case 2. As a result, a twisting force acting on inner connector 3 does not act on the conductive foil (not shown) of miniature circuit board 10.

As is clear from the above description, the present invention restricts the front-to-rear movement of inner connector 3 with stopper wall 1*a*. In addition, vertical movement is restricted by upper pinning protrusion 1*b* and lower pinning protrusion 2*c*. As a result, inner connector 3 is firmly held in place. Even if inner connector 3 moves due to a twisting force, because miniature circuit board 10 is flexibly restrained, the soldered contacts can move slightly and this prevents the soldered connections from separating from the conductive foil of the miniature circuit board 10. The electrical integrity of the electrical connector is maintained.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrical connector housing a miniature circuit board inside a connector case comprising:

an inner connector electrically connected to said miniature circuit board;

a shield case substantially surrounding said inner connector;

means for rigidly attaching said inner connector to said connector case; and means for flexibly attaching said miniature circuit board to said connector case whereby said miniature circuit board is allowed a range of motion without stressing said miniature circuit board.

2. An electrical connector housing a miniature circuit board inside a connector case according to claim 1, wherein:

said means for rigidly attaching said inner connector to said connector case includes a stopper wall; and said means for flexibly attaching said miniature printed circuit board includes a board stopper.

3. An electrical connector housing a miniature circuit board inside a connector case according to claim 2, wherein:

said means for rigidly attaching said inner connector to said connector case includes at least an upper and lower pinning protrusion.

4. An electrical connector housing a miniature circuit board inside a connector case according to claim 1, further comprising:

a fastening lug disposed on said shield case; and said fastening lug being soldered to said miniature circuit board.

5. An electrical connector housing a miniature circuit board inside a connector case according to claim 1, wherein said inner connector includes a plurality of contacts.

6. An electrical connector housing a miniature circuit board inside a connector case according to claim 1, further comprising:

an upper and lower case;

said upper and lower case being made of an electrically insulating resin; and said upper and lower case substantially surrounds said electrical connector.

* * * * *